United States Patent [19]

Brock, Jr.

[11] 4,237,570

[45] Dec. 9, 1980

[54] POWER BRUSH APPARATUS

[76] Inventor: W. B. Brock, Jr., 875 W. 20 St., Hialeah, Fla. 33010

[21] Appl. No.: 65,455

[22] Filed: Aug. 10, 1979

[51] Int. Cl.[3] ..... A46B 13/02

[52] U.S. Cl. ..... 15/28; 51/170 T

[58] Field of Search ..... 15/22 R, 23, 24, 28, 15/29, 97 R, 98; 51/170 T, 180

[56] References Cited

U.S. PATENT DOCUMENTS

| | | | |
|---|---|---|---|
| 1,391,221 | 9/1921 | Tuttle | 15/28 |
| 1,604,500 | 10/1926 | Tannenbaum | 15/29 |
| 1,679,323 | 7/1928 | Mortlock | 15/29 |
| 4,102,290 | 7/1978 | Weiss | 15/24 X |

FOREIGN PATENT DOCUMENTS

| | | | |
|---|---|---|---|
| 118243 | of 1959 | U.S.S.R. | 15/29 |

*Primary Examiner*—Edward L. Roberts

[57] ABSTRACT

A power brush apparatus for use in cleaning airplanes or the like which includes an elongate hollow handle with a drive member coaxially mounted and journaled within the hollow handle and which drive member is connected at one end to a drive motor in a driving connection and at the opposite end to a stub shaft arranged in a housing at an angle of about 45° with respect to the longitudinal length of the handle and a brush of the rotatable type is secured for rotation to the terminal end of the stub shaft.

10 Claims, 4 Drawing Figures

POWER BRUSH APPARATUS

FIELD OF THE INVENTION

This invention relates to a power brush apparatus.

BACKGROUND OF THE INVENTION

As is perhaps well known, such as in cleaning air craft, it is often necessary that a long brush be utilized in order to reach various parts of an item to be cleaned. This invention is of such a brush for use in industrial cleaning. It is composed of an elongate handle having side grips intermediate the length and at the proximal end it is provided with a conventional air driven motor to rotate a powered rotatable brush head at the other end with a driving connection being through a longitudinally extending drive tube journaled within the handle and connected to the brush through a pair of beveled gears.

OBJECTS OF THE INVENTION

It is an object of this invention to provide an improved power apparatus which is highly useful for cleaning items in industrial settings, such as air craft and which is composed of an elongate handle having a brush at one end arranged for rotation about an axis which is generally at about 45° with respect to the longitudinal axis of the handle and wherein bevel gear members interconnect at the angled portion to transmit power from the air brush which is utilized to power a drive tube from the proximal end through the handle to turn the brush head.

In accordance with these and other objects which will become apparent hereinafter, the instant invention will now be described with reference to the accompanying drawings in which:

DESCRIPTION OF THE PREFERRED EMBODIMENT

Figure 1:
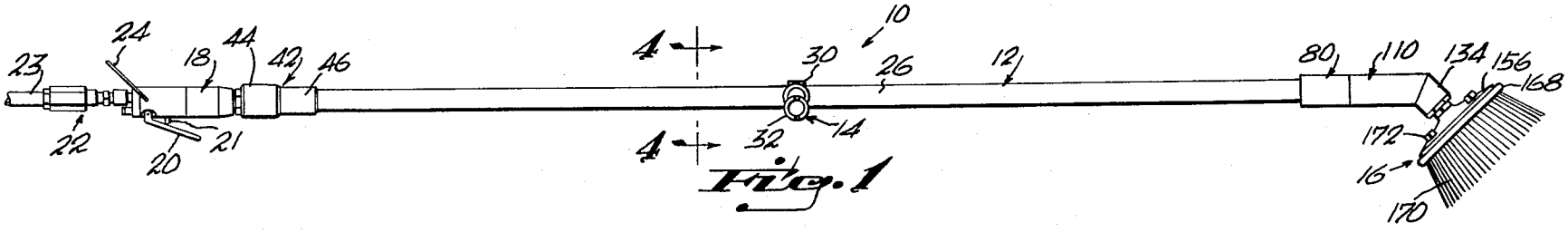
FIG. 1 is a side elevation view of a power brush apparatus constructed in accordance with this invention.

Referring to the drawings wherein like reference characters designate like or corresponding parts throughout the several views and referring particularly to FIG. 1, the power brush apparatus is designated generally by the numeral 10 and it includes an elongate handle 12. The handle 12 is provided, intermediate its length, with a hand grip means 14 to be described more fully hereinafter. At the distal end, that is the right-hand side of FIGS. 1 and 2, a brush head 16 is secured to the terminal end of the handle. At the proximal end of the apparatus, that is the left-hand side of FIG. 1, a conventional air motor 18 is provided. The air motor, as is conventional, includes an operator 20 movably connected for movement so as to depress a valve pin 21 to permit air to enter through the nipple 22 from a supply hose 23. The motor may be provided with a hanger in the form of a loop, as is designated by the numeral 24.

Connected to the motor by suitable means, to be described in a preferred embodiment, is an elongate tubular member 26 to the opposite end of which there is connected by suitable means the brush head.

Figure 4:
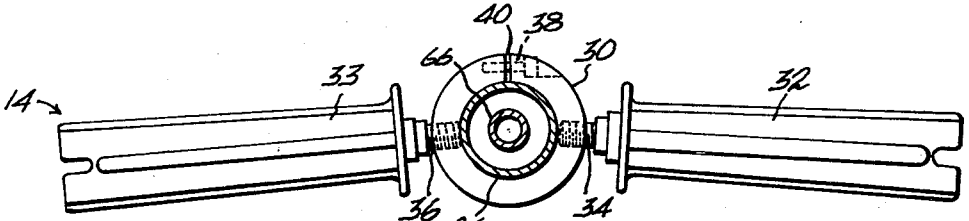
FIG. 4 is a view in cross section taken on the plane indicated by the line 4–4 of FIG. 1 and looking in the direction of the arrows.

Intermediate the length the hand grip means 14 are adjustably provided on the tube, see FIG. 4. A split ring 30 is provided about the tube, in which there are generally diametrically opposed threaded recesses to accommodate the threaded ends 34 and 36 of handles 32 and 33 which are adapted to bear against the surface of the tube 26. In the illustrated preferred embodiment, the split ring may be provided with a recess, as designated by the numeral 38 to accommodate a screw for clamping the same tight by tightening the split or gap indicated at the numeral 40.

Figure 3:
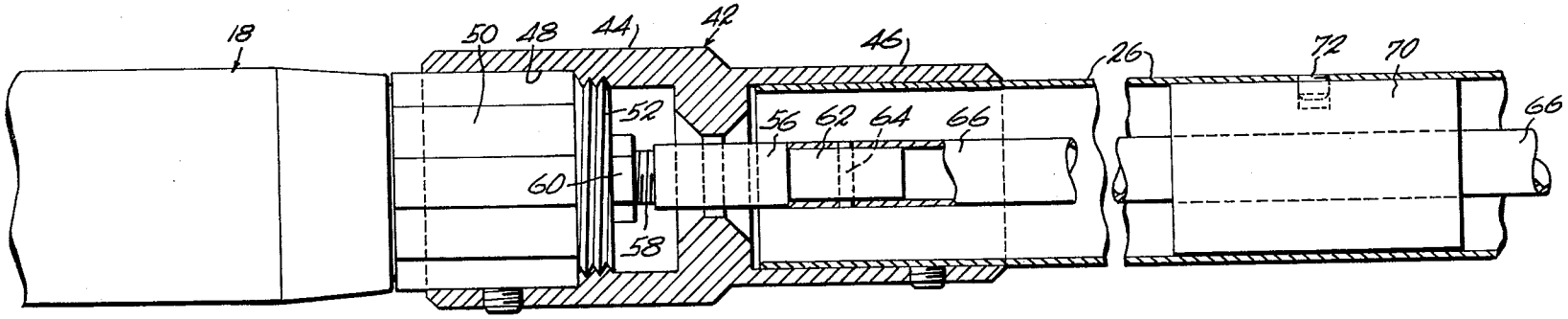
FIG. 3 is an enlarged view of the left-hand side of FIG. 1 shown in cross section.

Referring now to the left-hand side of FIG. 1 and FIG. 3, it is seen that the air motor 18 is connected to the tube 26 by means of an adapter 42 having a first end zone 44 and a second end zone 46. The recess 48 in the first end zone is sized to receive the end 50 of the standard air motor in threaded engagement as indicated at 52 with the drive shaft 58 as tightened by the nut 60 being in driving engagement through the connector 56 with a drive tube 66 in the end to which this extending portion 62 of reduced diameter on the connector 56 is connected by means of a pin 64. The drive tube 66 is supported within the elongate tube 26 by means of fixed nylon bearing blocks such as that indicated by the numeral 70 which are held in position, as by the screws 72.

Figure 2:
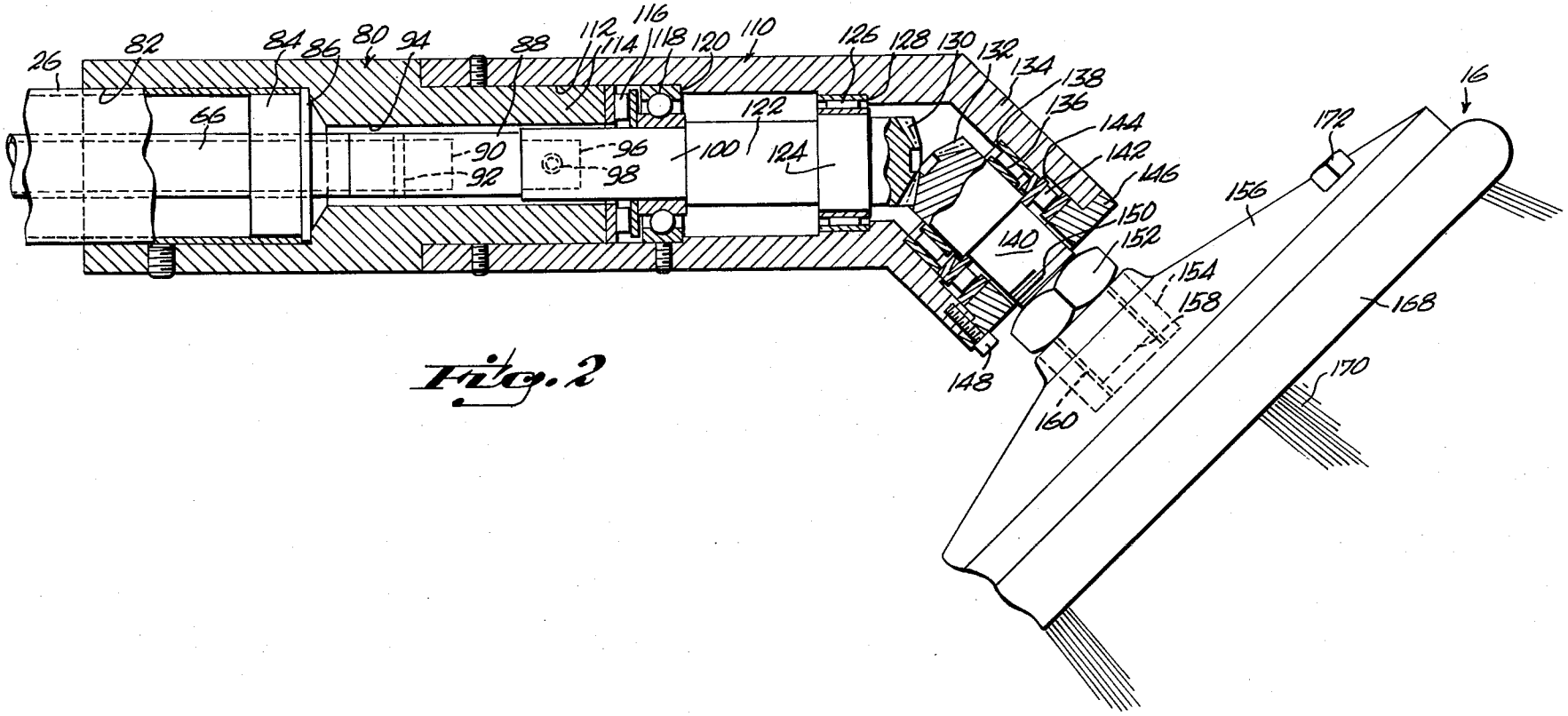
FIG. 2 is an enlarged view in cross section of the right-hand side of FIG. 1.

With respect to FIG. 2 of the drawings, it is seen that the brush head end is illustrated. The tube 26 is received within a fitting 80 in the recess 82 which is provided with a bearing 84 adjacent the terminal end which is kept by the flange 86 having a central through hole. The end of the drive tube 66 is connected by an extension 88 in which the end of the drive 66 is received as indicated by the numeral 90 and held in engagement therewith by the pin 92. The extension 88 is further connected to a gear support 122 having an end 100 supported by a bearing 118 and connected in a recess 96 by the pin 98 to the drive tube 66. An additional bearing 126 including the annular portion 124 is provided and a bevel gear is formed on the terminal end 130 of the gear support 122. An exterior sleeve or end piece 110, which is tubular and angled, is provided on the reduced end 114 in a tight fit with the surfaces as indicated by the numeral 112, being in engagement with one another and with a thrust bearing means 116 being captivated as indicated. The end 134 is angled preferrably at about 45 degrees and a bevel gear 132 is at all times in engagement with the bevel gear 130 which is held in position by the securement of the member 140 by means of the bearings 136 arranged in the annular recess 138 and held in position by means of the screw bolt 148 bearing against the cap member 146 which in turn engages the thrust bearing 142 that bears against the annular ring 144. The brush head extends with an inserted collar 146 through which the threaded end of the stub shaft 140 extends, therebeing a beveled gear 132 at all times in engagement with the foresaid beveled gear 130 in a driving connection. The brush head receives the end 158 of the threaded stub shaft which is received in threaded engagement in a threaded sleeve sized and fitted in a recess 154 of the brush head structure 156. The brush head structure is generally of rubbery material in the relative rigid range or of plastic and it is secured by threaded engagement of the lock nut 152. From the brush head there extends a brush carrier 168 from which bristles 170 extend, as is conventional, the latter being secured by nuts such as 172.

What is claimed is:

1. A power brush apparatus comprising, in combination, an elongate hollow handle having an inner end and an outer end, an elongate drive member having a first end and a second end and including spaced bearing members within said handle, an air operated drive motor including a drive shaft in coaxial relation with said drive member at the inner end of the handle, an adapter interconnecting the inner end and the motor, drive pin connector means interconnecting the drive member and drive shaft at the first end, an angled housing at the outer end of the handle including a proximal zone, a distal zone, and an intermediate angled zone, a fitting interconnecting the handle to the housing, a rotatable member in the proximal zone of said housing, a stub shaft rotatably mounted in the distal zone of said housing, bevel gears interconnecting the stub shaft and the rotatable member at said intermediate angled zone, and means interconnecting the rotatable member with said drive member, and thrust bearing means with the housing for the stub shaft and the rotatable member, and a rotatable brush removably secured to the terminal end of said stub shaft.

2. The device as set forth in claim 1 wherein annular cap means are provided about said stub shaft closing the distal zone of the housing.

3. The device as set forth in claim 1 wherein said rotatable brush comprises a brush head and means securing the brush head to the terminal end of the stub shaft, said brush head including removable bristle carrying means.

4. The device as set forth in claim 3 wherein said brush head includes a threaded sleeve on said brush head coaxial therewith and said stub shaft is threaded and said threaded stub shaft is in threaded engagement with said sleeve.

5. The device as set forth in claim 1 wherein the angle subtended by the distal and proximal zone of said housing is about 45°.

6. The device as set forth in claim 1 wherein said proximal and distal zones of said housing include shoulder means and said thrust bearing means are in engagement with said shoulders.

7. The device as set forth in claim 1 wherein said spaced bearing members comprise annular nylon bearing members at spaced intervals along and within said handle and said drive member comprises an elongate member of cylindrical form rotatable in said bearing members.

8. The device as set forth in claim 1 wherein handle means are provided exteriorly on said handle.

9. The device as set forth in claim 8 wherein said handle means comprises a split ring about said handle and means to tighten said split ring.

10. The device as set forth in claim 9 wherein said split ring includes laterally extending handle means.

* * * * *